United States Patent [19]

Hammond

[11] 4,035,070

[45] July 12, 1977

[54] APPARATUS AND METHOD FOR OPTICAL GENERATION OF A STRUCTURED CHARGE-DISCHARGE PATTERN ON A PHOTORECEPTOR

[75] Inventor: Thomas J. Hammond, Penfield, N.Y.

[73] Assignee: Xerox Corporation, Stamford, Conn.

[21] Appl. No.: 642,103

[22] Filed: Dec. 18, 1975

[51] Int. Cl.[2] ..... G03G 15/00

[52] U.S. Cl. ..... 355/3 R; 240/1 EL; 355/67

[58] Field of Search ..... 355/3 R, 11, 67, 1; 240/1 EL, 1 LP, 2.1

[56] References Cited

U.S. PATENT DOCUMENTS

| | | | |
|---|---|---|---|
| 2,831,453 | 4/1958 | Hardesty | 240/2.1 X |
| 3,120,790 | 2/1964 | Carlson et al. | 355/3 R |
| 3,313,623 | 4/1967 | Bixby | 355/4 X |
| 3,936,173 | 2/1976 | Kidd et al. | 355/3 R |

*Primary Examiner*—Richard L. Moses

[57] ABSTRACT

Apparatus and method for providing a structured distribution for charge stored on a photoreceptor element. An optical element located adjacent to the photoreceptor, includes two generally parallel reflecting surfaces, one surface being partially reflecting and one surface being substantially totally reflecting. A narrow collimated beam of radiation, introduced at an angle to the reflecting surfaces, produces multiple reflections between the reflecting surfaces of the optical element. A portion of the collimated beam exits from the cavity through the partially reflecting surface with each reflection therefrom. The resulting array of substantially parallel light beams is arranged to scan a surface of a photoreceptor having a charge stored thereon. The photoreceptor charge in the region of the incident light beam is dissipated by the impinging radiation resulting in a modulation or structuring of the stored charge. This photoreceptor charge modulation can be utilized to improve image reproduction.

A filter can be interposed between the optical cavity and the photoreceptor to correct for the gradually decreasing intensity of each successive array beam exiting from the optical element, the decreasing beam intensity the result of loss during previous reflections.

A primary optical element can be utilized in conjunction with a plurality of secondary elements to reduce the total path length of the scanning radiation beam, thereby minimizing the spreading of the beams resulting from multiple reflections. Further, by the interlacing of secondary element beam arrays, the beam density from each secondary element can be greater than the beam density of the scanning radiation beam array.

When the collimated radiation beam is operated continuously, a line pattern is produced on the stored charge of the moving photoreceptor. When the collimated radiation beam is operated in an intermittent mode, a dot pattern can be formed on the stored photoreceptor charge.

8 Claims, 3 Drawing Figures

APPARATUS AND METHOD FOR OPTICAL GENERATION OF A STRUCTURED CHARGE-DISCHARGE PATTERN ON A PHOTORECEPTOR

This invention relates generally to electrostatographic image reproduction and more particularly to apparatus for providing a microstructure to a charge distribution stored on a photoreceptor for enhancement of image reproduction.

It is known in the prior art to modulate the stored charge on a photoconductor surface to improve electrostatographic image reproduction. For example, solid area or continuous tone image reproduction can thereby be improved. The modulation of the charge distribution on the photoreceptor can take place before or during the exposure of the image on the photoreceptor. Thus, modulation can be accomplished sequentially with the image exposure by a screen interposed between the image and photoreceptor, or the screen can be separately imaged to provide structuring of the stored photoreceptor charge. Similarly, photoreceptor charge modulation can be provided by apparatus for application of a structured charge to the photoreceptor or by apparatus for removal of a structured charge from a charged photoreceptor.

Another technique providing structure to the charge distribution of the photoreceptor is to illuminate the photoreceptor with radiation possessing an appropriate structure or pattern. It is desirable that the apparatus used to provide the appropriate modulation be compact to conserve space in the reproduction machine. At the same time, it is desirable that the apparatus not be dependent on the position relative to the photoreceptor so that the modulating apparatus can be positioned away from the photoreceptor where foreign materials will not degrade the amplitude or frequency of the charge modulation.

It is therefore an object of the present invention to provide an improved electrostatographic apparatus.

It is another object of the present invention to provide an improved method of structuring a distribution of charge on a photoreceptor.

It is a further object of the present invention to provide a compact apparatus for modulation of stored photoreceptor charge wherein the position of the modulating apparatus relative to the photoreceptor is not critical.

It is a further object of the present invention to provide apparatus for generating a multiplicity of collimated and substantially parallel radiation beams.

It is yet another object of the present invention to provide an optical element, wherein a radiation beam introduced into the cavity has a multiplicity of internal reflections, and wherein a portion of the radiation beam is transmitted from the element during preselected ones of the internal reflections.

It is a more particular object of the present invention to provide a pair of generally parallel reflecting surfaces, wherein a collimated beam of radiation entering the element formed by the surfaces at an angle is multiply-reflected, and radiaton impinging upon one surface is at least partially transmitted through the reflecting surface.

It is another more particular object of the present invention to provide a pair of generally parallel reflecting surfaces, wherein a collimated radiation beam, introduced at an angle into the element formed by the surfaces, is multiply-reflected from the surfaces, a portion of the radiation beam reflected by at least one surface is transmitted through the surface.

It is yet another object of the present invention to provide an optical element for converting a collimated radiation beam into a multiplicity of collimated radiation beams and wherein apparatus associated with the optical element equalizes the radiation beam intensity for the multiplicity of radiation beams.

The aforementioned and other objects are accomplished, according to the present invention by an optical element or cavity comprised of a substantially totally reflecting surface and a partially reflecting, partially transmitting surface positioned opposedly to the totally reflecting surface and generally parallel thereto. A collimated beam of radiation, introduced between into the cavity at an angle, is multiply reflected by the surfaces. The radiation transmitted through the partially reflecting surface is comprised of a multiplicity of generally parallel radiation beams. Applying the radiation beams to a photoreceptor surface having a motion relative to the radiation beams, will provide structure or modulation for the charge stored on the photoreceptor.

The collimated radiation source can be a laser beam. A continuously variable filter can be introduced into the path of the parallel radiation sources to equalize the intensity of the transmitted radiation beams.

To minimize the effect of the decreasing intensity and spreading of the radiation beams resulting from the long path length and associated numerous reflections, a first optical cavity with relatively widely separated emerging radiation beams can provide the input radiation beams for a plurality of cavities having relatively dense emerging radiation beams.

The angle at which the collimated light source is introduced into the optical cavity in conjunction with the spacing between the plates can determine the density of emerging radiation beams.

These and other features of this invention will be understood upon reading of the following description along with the drawings of which:

Figure 1:
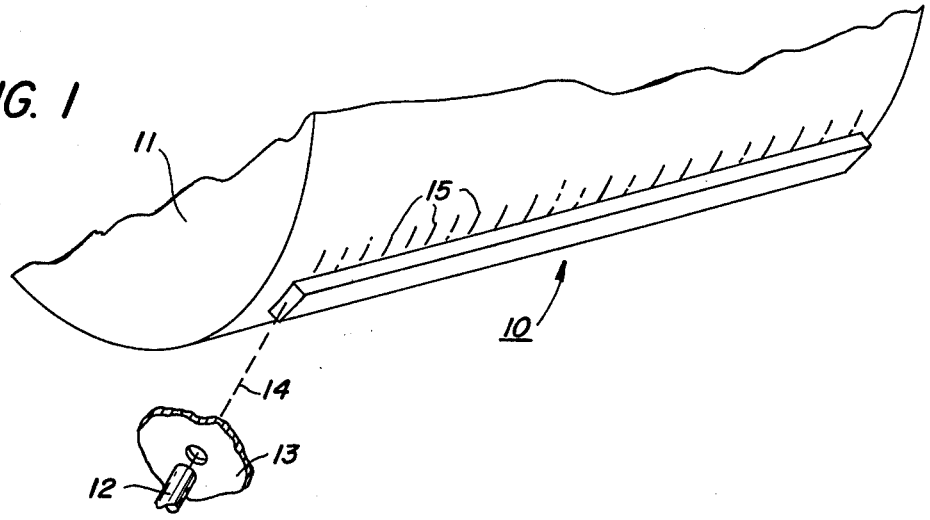
FIG. 1 is a schematic representation of the present invention used to provide optical structuring or modulation of charge stored on a drum photoreceptor.

Referring now to FIG. 1, the position of the optical modulation apparatus 10, relative to the photoreceptor surface 11 is shown. Because the array of beams emerging from apparatus 10 are collimated and generally parallel, the position of the apparatus relative to the photoreceptor is not critical. The apparatus 10, is supported at distance from the surface of the photoreceptor by a mechanism not shown. An illumination source 12, typically a laser in the preferred embodiment, provides a source of collimated radiation 14 to a window in apparatus 10. The illumination source radiation 14 can be further collimated and/or extraneous radiation minimized by means of an aperature in surface 13. The introduction of the collimated radiation 14 into apparatus 10 results in a multiplicity of collimated radiation beams 15 striking the photoreceptor surface 11.

Figure 2:
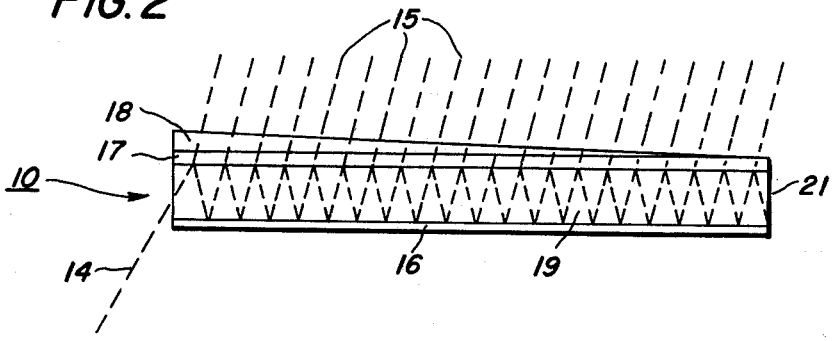
FIG. 2 is schematic cross-sectional diagram of the optical cavity providing a multiplicity of collimated beams of radiation.

Referring now to FIG. 2, a cross-section diagram of the apparatus 10, according to the preferred embodiment is shown. The collimated radiation 14 enters optical cavity 19. In the preferred embodiment, optical caavity 19 is comprised of a medium generally transparent to the impinging radiation. Reflecting surfaces 16 and 17 are applied to surfaces of the cavity medium. Reflecting surface 16 is fully reflecting while reflecting surface 17 is partially reflecting, i.e. a fraction of the impinging radiaton can be transmitted therethrough. The reflecting surfaces are substantially parallel. Thus collimated radiation 14 entering cavity 10 will be multiply reflected between surfaces 16 and 17. Moreover, upon each reflection of the collimated radiation from surface 17, a portion of the collimated radiaton will be transmitted through the surface resulting in an plurality of generally parallel collimated radiation beams 15.

As the radiation beam propagates by multiple reflections, through cavity 19, the intensity of the beam will diminish due to radiation transmittion through the partially reflecting surface. Thus the intensity of the transmitted radiation beams will correspondingly diminish. To compensate for the decrease in intensity of radiation beams 15, a variable filter 18, such as a continuously variable (wedge) filter, can be provided. The filter can provide intensity compensation so that the emerging beams are of a generally uniform intensity. In the preferred embodiment, an absorbing material 21 is placed at one end of the optical cavity 19 in order to absorb the remaining radiation and minimize scattered radiation.

While the above description provides for a cavity 19 comprised of a relatively high transmitting material, surfaces 16 and 17 can also be suppoted by a means not shown and the cavity medium can be air. It will be clear that the density of the collimated radiation beam 15 can be altered by varying the angle relative to the surface 17, the surface at which the radiation 14 is incident upon the apparatus 10. It is also clear that the density of beams can also be altered by varying the distance between reflecting surfaces 16 and 17.

Figure 3:
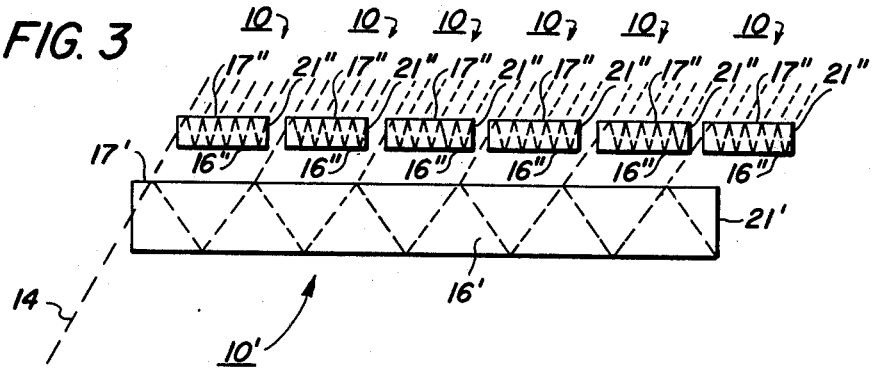
FIG. 3 is a schematic representation of the use of a plurality of optical cavities for minimizing the effect of multiple reflections of the radiation beam.

Referring now to FIG. 3, apparatus for providing a multiplicity of collimated radiation beams 15 from a single collimated input beam 14 is shown. This apparatus can minimize the decrease in intensity of the multiplicity of collimated radiation beams 15 across the extent of the photoreceptor, as well as reduce the decollimating effect, resulting from the excessive path length due to multitude of beam reflections of the array beams. The de-collimating effect can provide a limitation to the utility of the apparatus in providing a miscrostructure for the charge stored on a photoreceptor surface. The apparatus is comprised of a primary optical cavity 10' and a plurality of secondary optical cavities 10. A collimated radiaton beam 14 is introduced into optical cavity 10' where the beam is reflected from the surface 16' and partially reflected and partically transmitted at surface 17'. The partially transmitted portions of the radiation beam transmitted through surface 17', are introduced in optical cavities 10. In optical cavities 10, the collimated radiation beam is reflected from surfaces 16'' and partially reflected and partially transmitted by surfaces 17''. The collimated radiation beams 15 emerging from surfaces 17'' are applied to the photoreceptor surface to form an appropriate pattern.

It will be clear that the wedge filter described in conjunction with FIG. 2 can be utilized with the optical cavities of FIG. 3. It will be further clear that to those skilled in the art, that by radiation beam 14 and optical cavities 10 can be arranged to eliminate gaps in the radiation beam shown in the schematic arrangement of FIG. 3. In addition, optical cavities 10 can be physically coupled to optical cavity 10'. The apparatus of FIG. 3 reduces the radiation beam de-collimating effects resulting from an excessive path length due to numerous reflections of the single input beam in the single optical cavity configurations.

Utilizing the described apparatus, a plurality of collimated and generally parallel radiation beams of high density can be provided. The array of beams can be used to discharge the charged surface of a photoreceptor. As the photoreceptor moves relative to the apparatus a microstructure is supplied to the charge distribution of the photoreceptor. When the illumination source is continuous, a linear structure can be provided for the charge stored on the photoreceptor. By pulsing the illumination source, a dot structure can be provided. It will be clear to those skilled in electrostatographic arts that the structure can be applied before or after the exposure of the photoreceptor surface to the image for which reproduction is desired. It will be further clear that density of the structure should sufficiently low to be practical, but sufficiently high to provide acceptable resolution of the reproduced image. It will be further clear to those skilled in the electrostatographic arts that when the modulation density is with the limits described above, the image reproduction can be improved.

The above description is included to illustrate the operation of the preferred embodiment and is not meant to limit the scope of the invention. The scope of the invention is to be limited only by the following claims. From the above discussion, many variations will be apparent to one skilled in the art that would yet be emcompassed by the spirit and scope of the invention.

What is claimed is:

1. Apparatus for providing a multiplicity of collimated radiation beams from a single collimated radiation beam comprising:

a substantially totally reflecting first surface;

a second surface generally parallel to said first surface, said second surface being partially reflecting, said first and said second surface providing a cavity, means for introducing said single collimated radiation beam into said cavity wherein said multiplicity of collimated beams is provided by radiation transmitted through said partially reflecting surface, and a variable filter for generally equalizing intensity of said multiplicity of beams.

2. Apparatus for modulating charge stored on a photoreceptor of an electrostatic reproduction system comprising:

a source of collimated radiation; and at least one optical element, said optical element including means for admitting said collimated radiation to said optical elements, said optical element further including a partially reflecting and partially transmitting surface and a substantially totally reflecting surface, said surfaces being generally parallel, said collimated radiation admitted relative to said surfaces to provide a multiplicity of collimated and generally parallel radiation beams from said partially reflecting surface, said optical element positioned so that said multiplicity of radiation beams impinge on said photoreceptor.

3. An improved electrostatographic apparatus for reproduction of images of the type having a photoreceptor to which said images are applied electrically charging said photoreceptor, wherein the improvement comprises apparatus for applying a multiplicity of radiation beams to said photoreceptor for producing a structured pattern of charge on said photoreceptor including;

a first fully reflecting surface;

a second partially reflecting surface, said first surface substantially parallel to said second surface; said second surface positioned in a neighborhood of said photoreceptor, and a source of collimated radiation, said source positioned to introduce said collimated radiation between said first and said second surface.

4. Apparatus for converting a single collimated radiation beams into a multiplicity of radiation beam comprising:

a primary optical cavity, said first cavity including a first radiation reflecting surface and a second radiation reflecting surface, wherein said second surface can transmit a portion of radiation impinging thereon, wherein said optical cavity includes means for admitting said single radiation beam; and a plurality of secondary optical cavities, first surfaces of said secondary optical cavities reflecting impinging radiation, second surfaces of said secondary optical cavities partially reflecting and partially transmitting radiation impinging thereon, said secondary optical cavities adapted to receive said primary cavity transmitted radiation portion, wherein radition from said secondary cavities provides said multiplicity of radiation beams.

5. The radiation beam apparatus of claim 4 wherein a multiplicity of radiation beams form at least two of said secondary optical cavities are combined.

6. A compact system for providing a multiplicity of collimated radiation beams comprising:

a source of collimated radiaton; and at least one optical cavity, said optical cavity including a first generally totally reflecting surface, said optical cavity including a second partially reflecting and partially transmitting surface, said cavity including means for introducing said collimated radiation therein, said collimated radiation propagating along said optical cavity by means of reflections between said first and second surfaces, wherein said multiplicity of collimated radiation beams are produced by said transmission of said propagating collimated radiation through said second surface.

7. The compact system for producing radiation beams of claim 6 wherein density of said multiplicity of beams can be controlled.

8. The compact system for producing radiation beams of claim 6 further including a variable filter in a path of said multiplicity of beams, said filter generally equalizing a radiation intensity of said multiplicity of beams.

* * * * *